US005488921A

United States Patent [19]

Spragg

[11] Patent Number: 5,488,921

[45] Date of Patent: Feb. 6, 1996

[54] FLEXIBLE FABRIC BARGE APPARATUS AND METHOD

[76] Inventor: Terry G. Spragg, 420 Highland Dr., Manhattan Beach, Calif. 90266

[21] Appl. No.: 437,185

[22] Filed: May 8, 1995

Related U.S. Application Data

[63] Continuation-in-part of Ser. No. 103,287, Aug. 6, 1993, Pat. No. 5,413,065.

[51] Int. Cl.[6] ..... B63B 35/28

[52] U.S. Cl. ..... 114/256; 114/26; 114/30; 114/74 T

[58] Field of Search ..... 114/256, 253, 114/254, 77 A, 242, 26, 27, 28, 29, 30, 74 A, 77 R, 74 R, 74 T, 345; 441/35, 44, 45, 133

[56] References Cited

U.S. PATENT DOCUMENTS

| | | | |
|---|---|---|---|
| 2,999,253 | 9/1961 | Lewis | 9/2 |
| 3,067,712 | 12/1962 | Doerpinghaus | 114/74 |
| 3,679,025 | 7/1972 | Rummel | 182/20 |
| 3,774,563 | 11/1973 | Anderson, Sr. et al. | 114/0.5 T |
| 3,779,196 | 12/1973 | Knaus et al. | 114/74 T |
| 4,829,923 | 5/1989 | Copson et al. | 114/26 |
| 5,331,911 | 7/1994 | Bost et al. | 114/26 |

*Primary Examiner*—Stephen Avila
*Attorney, Agent, or Firm*—Seed and Berry

[57] ABSTRACT

Flexible fabric barges are connected together in a string for towing. The barges are interconnected by fabric sleeves which have zipper connections. A fabric towing cone is zipper connected to the lead barge. Each barge includes an elongated opening that allows cargo to be efficiently discharged from the barge. The elongated opening can be a circumferentially elongated opening that divides the barge into front and rear sections or the elongated opening can be a longitudinal opening which divides the barge into right and left sections.

18 Claims, 3 Drawing Sheets

FLEXIBLE FABRIC BARGE APPARATUS AND METHOD

CROSS-REFERENCE TO RELATED APPLICATION

This is a continuation-in-part of application Ser. No. 08/103,287, filed Aug. 6, 1993, now U.S. Pat. No. 5,413,065.

TECHNICAL FIELD

The present invention relates to flexible fabric barges used singly or towed in a string.

BACKGROUND OF THE INVENTION

The safe and healthy disposal of sewage is of great importance, especially in highly populated areas. In some places, sewage is dumped directly into a large body of water via a pipeline extending into the water, so that the sewage will be dissipated by water currents and consumed by microorganisms. However, discharging the sewage from a single source such as a pipeline can overwhelm the ability of the water and microorganisms to dissipate and consume the sewage. As a result, such sewage produces offensive odors and presents numerous health hazards to humans, animals, and plants that rely on the body of water for various uses.

Several remedies have been proposed to alleviate the sewage problems, but such remedies present problems of their own. For example, one solution proposed is simply to extend the sewage pipeline further into the body of water so that the sewage is discharged further from human populations. Extending such sewage pipelines well out into the water is very expensive and does not eliminate the damage caused to animal and plant populations. Another proposed remedy is to treat the sewage with various treatment procedures prior to discharge, making the sewage less threatening to the environment. However, the cost of the treatment plants needed to treat the sewage is extremely high.

The use of flexible fabric barges has been proposed for storage of oil recovered from an oil spill and for transporting fresh water in a salt water body of water. The latter use potentially involves the transporting of huge amounts of fresh water, possibly in a hostile wind and wave environment, and over distances which may be well in excess of a thousand miles between a supply port a discharge port. However, prior to the inventor of the present invention, no one has proposed using such flexible barges to transport cargo other than oil or water, such as sewage. In addition, prior art flexible barges pump the water or oil into and out of the interior of the barges via small circular ports in the barges. Such small circular ports are too small to be used to efficiently remove other cargo, such as sewage or wood chips, from the interior of the barges.

SUMMARY OF THE INVENTION

The present invention recognizes that to economically transport fresh water or other cargo by sea using flexible fabric barges it is advantageous to tow several barges in a string with each barge being from 25 to 50 feet in diameter and from 200 to 800 feet in length, and that for loading and unloading purposes at docking sites, the barges should be easily coupled and separated when filled.

In accordance with the invention a series of fabric barges are connected together by fabric sleeves and suitable connecting elements, preferably zippers. The lead barge is preferably connected to a tow line by a fabric nose cone. Preferably each barge has a collar at both ends and the sleeves are zipper connected to the collars The front collar on the lead barge can be zipper connected to the nose cone. The opposite end portions of each barge preferably have the same configuration and the main body portion of each barge is generally cylindrical.

In a preferred embodiment of the invention, each barge includes an elongated opening for discharging cargo, such as sewage, wood chips, or fresh water. Attached to opposite sides of the elongated opening are fastening elements, such as zipper teeth, that engage each other to releasably close the elongated opening. In a first preferred embodiment, the elongated opening extends completely around the circumference of the barge transverse to the elongation of the barge to divide the barge into front and rear sections. In a second preferred embodiment, the elongated opening extends longitudinally on the barge to divide a main body portion of the barge into left and right sections when viewed from the front of the barge. Using flexible barges with large, recloseable elongated openings to efficiently discharge and disperse sewage is much less expensive than prior art treatment plants and underwater pipelines.

DETAILED DESCRIPTION OF THE INVENTION

Figure 1:
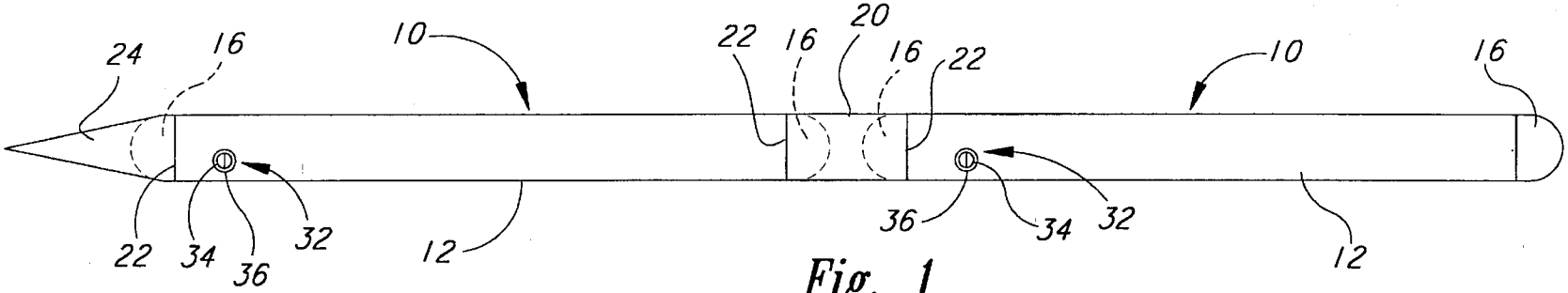
FIG. 1 is a side elevational view showing two barges coupled together in accordance with the present invention.

Referring to the drawings, a barge 10 is illustrated having a central main body 12 which is cylindrical if filled. The main body 12 is preferably fabricated from multiple rectangular fabric sections **12*a* which are joined along longitudinal seams 14. At its ends the main body 12 is joined to respective bulbous end portions 16 of like design at circumferential seams. At or adjacent these circumferential seams the main body 12 is joined to collars 18 in the preferred embodiment. These collars are used in conjunction with fabric sleeves 20. The collars and sleeves have complementing sets 22 of zipper components so that the collars and sleeves can be easily connected together. A fabric nose tow cone 24 is provided with a set of zipper components to register with the zipper components on the front collar 20 of the lead barge. This nose cone is reinforced at the nose and connected to a suitable towing fitting 26** or bridle.

As an alternative arrangement, for example, the sleeves 20 can be permanently connected at one end to the collar at one end of a respective barge, and zipper connected at its other end to the collar at the other end of a like barge.

As still another alternate, the collars 18 can be extended as sleeve extensions having a length of about one-half that of the sleeves 20, and have a set of zipper components mounted at their free ends to connect the sleeve extensions together. With this arrangement the zipper connections would be located midway between adjacent barges.

The zipper connection 22 of the sleeves 20 is not water tight so that sea water will be between the ends of the barges to act as a cushion. Similarly, the forward end of the nose cone 24 is open sufficiently to permit the nose cone to be full of sea water.

Figure 2:
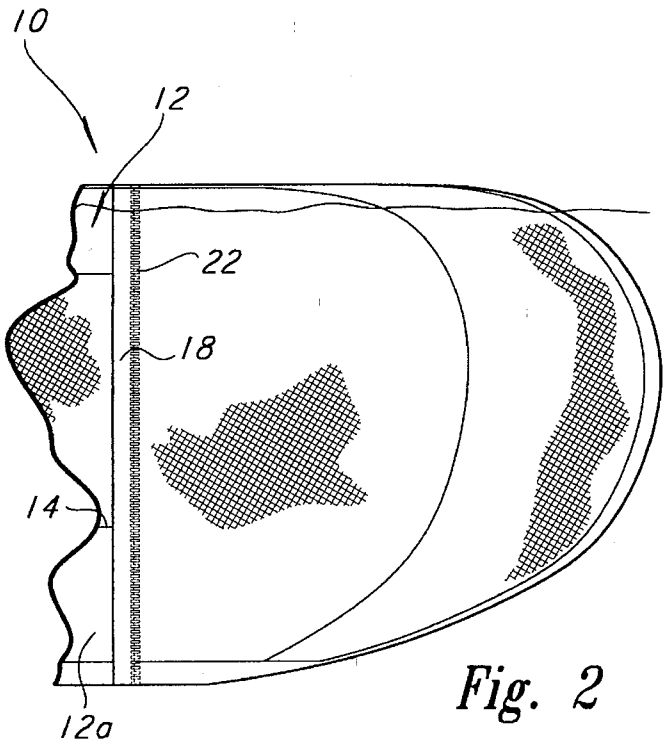
FIG. 2 is a side elevational view of an end portion of one of the barges when about 90% full of cargo.
Figure 3:
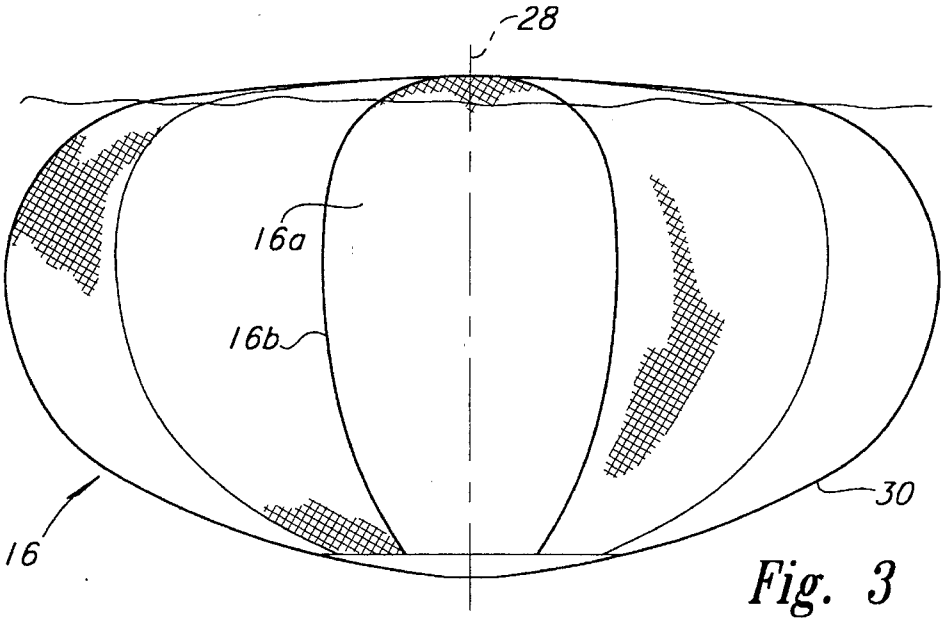
FIG. 3 is a front elevational view of the end of the barge shown in FIG. 2.

The barges will normally be 90% full of cargo and hence will have a transverse "filled" profile which is laterally distorted as indicated in FIGS. 2–3. Referring to FIG. 3, it is preferred that the front and rear portions 16 of the barge have the shape of the front half and rear half, respectively of the surface of a three-dimensional body of rotation having the vertical center line 28 of the main body portion 12 as an axis of rotation and the main body profile 30 at the transverse location as the generatrix when the barge is 90% full. The end portions 16 can be fabricated by subdividing them into multiple fabric sections **16*a* joined at seams 16*b***.

The zippers 22 have sets of large individual plastic teeth elements fixed on respective two-ply woven fabric mounting strips each enclosing a cord along a longitudinal side edge portion. The cord preferably has a stainless steel core surrounded by a PVC sleeve. The teeth elements are confined against movement relative to their mounting strip by the cords. The two-plies of each mounting strip straddle end portions of the respective sleeve collar 18 and are welded or other mounted thereto. The teeth elements are molded from a suitable plastic and may be of standard shape for interfitting responsive to gliding of the slide element. The slide element stays with one of the sets of zipper teeth and is interfitted with an entry portion of the complementing mounting strip. This may be accomplished by a diver. The zippers 22 may be opened and closed by a diver or by a machine moving the slide element.

The barges 10 are provided with one or more ports 32 for inputting and discharging cargo. These ports can comprise grommets 34, about 12 inches in diameter, which are secured in a water tight connection to the rims of appropriate openings in the barge fabric. The grommets are internally threaded to receive removable threaded plugs 36 for closing the ports 32.

It will be appreciated from the foregoing description that two or more barges can be easily connected together in a string with the lead barge being fitted with the nose cone 24 for towing the string of barges. At the delivery site the barges can be easily disconnected from one another and maneuvered to an unloading station.

In addition to transporting oil or water, the flexible barges 10 of the present invention can also be used to transport sewage to remote locations for disposal. As with the water or oil, the sewage can be input into each barge 10 through the ports 32 via a hose or pipe connected to the sewage source. The barges can then be towed out to various locations at sea and then emptied to disperse the sewage.

Although discharging the sewage from the ports 32 is possible, such a scheme is impractical for at least two reasons. First, the ports 32 are relatively small, e.g., one foot diameter, and thus the barges would require numerous such ports to quickly empty the barges. In addition, the ports typically are located on the top side of the barges which would require a pumping mechanism to pump the sewage out of the barges through the ports. Such a pumping mechanism would have to be carried out to sea with the barges and coupled to the ports, which would waste time and expenses.

Figure 4:
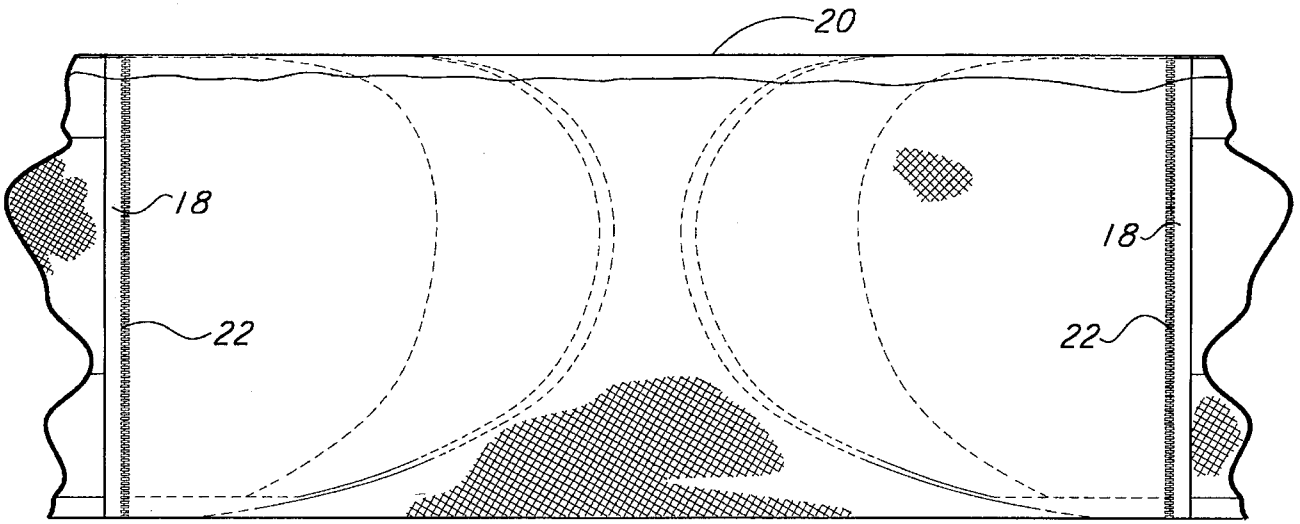
FIG. 4 is a fragmentary side elevational view showing the sleeve connection between barges.
Figure 5:
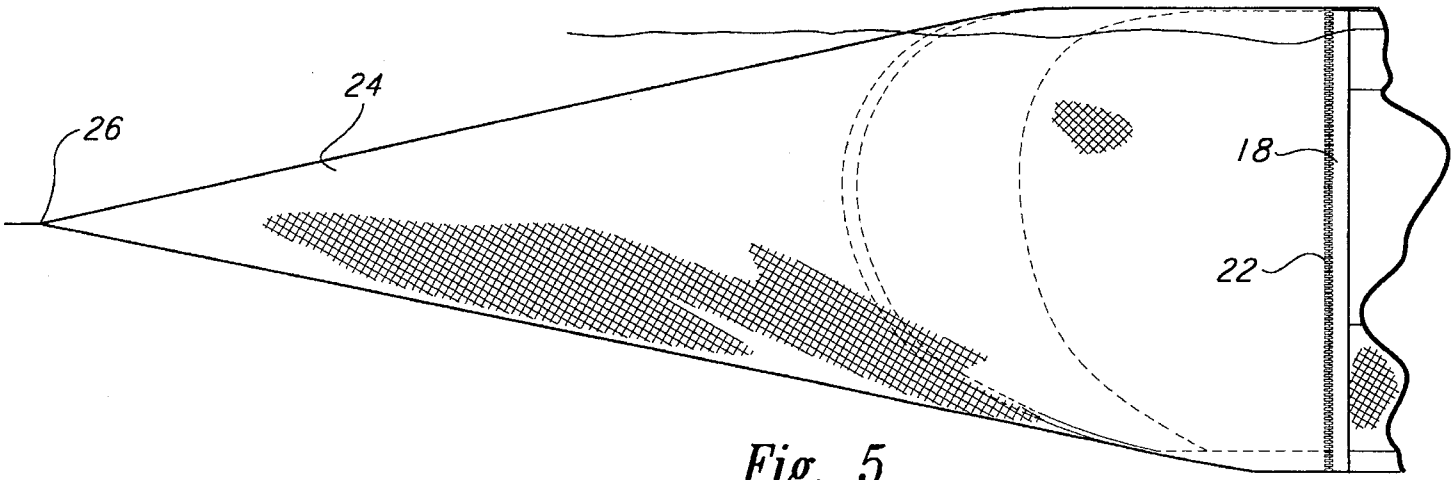
FIG. 5 is a fragmentary side elevational view showing the nose cone in operating position.
Figure 6:
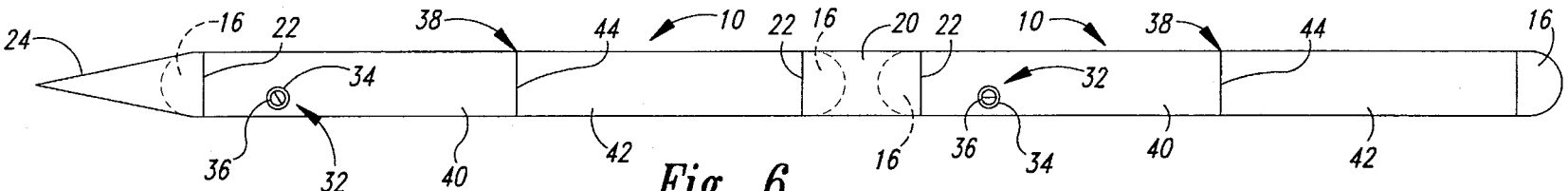
FIG. 6 is a side elevational view showing two barges coupled together with each barge including a circumferentially elongated opening in accordance with the present invention.

Shown in FIG. 6 is an alternate embodiment of the present invention in which the flexible barges 10 are designed to efficiently discharge their cargo, such as sewage, without requiring a pumping mechanism. Each barge 10 includes a circumferentially elongated opening 38 that divides the barge into a front section 40 and a rear section 42. Preferably, the circumferentially elongated opening 38 extends completely around the circumference of the barge 10 to enable the barge to be completely separated into the front and rear sections 40, 42. The opening 38 is closed by a releasable fastener 44 that couples the front section 40 with the rear section 42. In the preferred embodiment shown in FIG. 6, the releasable fastener 44 is a zipper similar to the zippers 22 used to connect the collars 18 to the sleeves 20 as shown in FIG. 4. Preferably, the releasable fastener 44 is of substantially the same strength (approximately 800–1000 lbs/inch) as the fabric used for the surface of the barge 10 so that the barge is not divided unintentionally at the releasable fastener.

Figure 7:
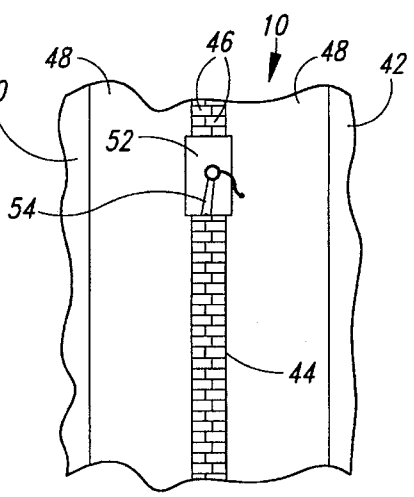
FIG. 7 is a fragmentary side elevational view showing the circumferentially elongated opening of FIG. 6 when closed by a zipper in accordance with the present invention.

Shown in FIG. 7 is a close-up view of the zipper 44 and adjacent areas of the front and rear sections 40, 42 of the barge 10. The zipper 44 has a set of large individual plastic teeth 46 fixed on respective two-ply woven fabric mounting strips 45. The two plys of each mounting strip 48 straddle end portions of the respective front and rear sections 40, 42 and are welded or otherwise mounted thereto.

To enable the zipper 44 to be opened and closed, the zipper includes a slide element 52. The slide element 52 can stay with one of the sets of zipper teeth 46 so that the slide element is not lost when the zipper 44 is opened. Alternatively, the slide element 52 could be removable from the zipper 44 so that one slide element could be used for the zippers 22 and the zippers 44 for all of the barges 10 in a train of barges. To close the zipper 44, and thereby close the opening 38, the slide element is moved circumferentially around the zipper by a diver or by an appropriate machine. When the zipper is closed, a pin 54 is inserted into the zipper 44 immediately behind the slide element 52 to lock the slide element in place and prevent it from opening the zipper. Preferably, the locking pin 54 is attached to the zipper 44 by a line 56 so that the zipper locking pin is not lost.

The design of the barge 10 with the circumferentially elongated opening 38 enables the barge, or a string of barges, to transport and discharge large amounts of sewage into the ocean away from populated areas. A preferred method of transporting and discharging sewage begins by closing the circumferentially elongated opening 38 using the zipper 44. After the zipper 44 is closed and locked by the pin 54, the sewage is pumped into the barge via the port 32. After the barge 10 is filled sufficiently with sewage, the barge is towed to an appropriate location at sea that preferably is far from populated areas. To discharge the sewage at the appropriate location, the zipper locking pin 54 is detached from the zipper 44 to allow the slide element 52 to open the zipper. After the locking pin 54 is removed from the zipper, the zipper can be opened simply by continuing to tow the barge 10 in the forward direction. The weight of the sewage in the rear section 42 while the front section 40 is being towed in the forward direction will enable the zipper to open automatically. Alternatively, a diver or machine could open the zipper by sliding the slide element 52 circumferentially around the barge. While the zipper is being opened, the sewage will discharge from the barge 10 via the opening 38.

After each section of the barge 10 is emptied, the barge can be removed from the string of barges by opening the barge's zipper connection 22. The empty barge can be retrieved by a tugboat accompanying the string of barges. After each barge is emptied, the next barge in the string of barges can be opened and emptied in a similar manner until the entire string of barges is emptied. By emptying the string of barges one barge at a time, the sewage can be discharged over a wide area. Discharging the sewage over a wide area increases the ability of the water to further disperse the sewage and enables the microorganisms in the water to consume the sewage.

Figure 9:
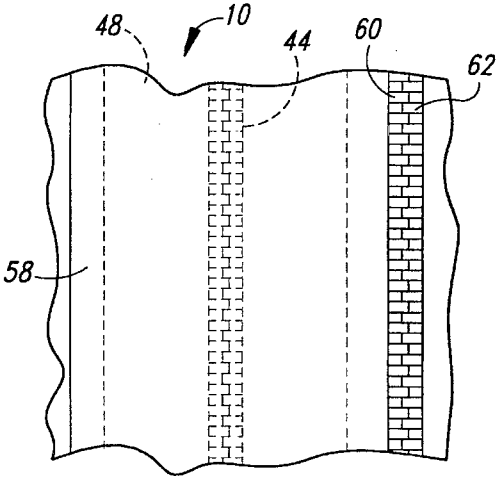
FIG. 9 is a fragmentary side elevational view showing the zippered, circumferentially elongated opening of FIG. 6 when sealed by a sealing flap.
Figure 8:
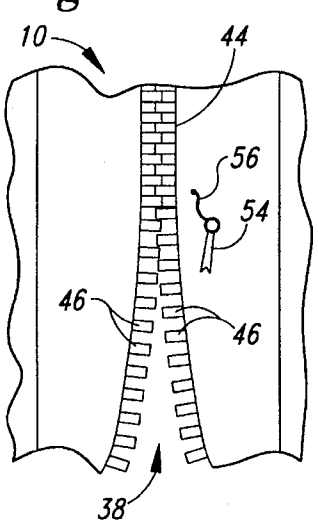
FIG. 8 is a fragmentary side elevational view showing the circumferentially elongated opening of FIG. 6 as the zipper is being opened.

In a preferred embodiment, each barge 10 includes a sealing strip 58 that extends across the zipper 44 to seal the zipper as shown in FIG. 9. Sealing the zipper 44 using the sealing strip 58 prevents sewage from being discharged unintentionally and prevents water from entering into the barge 10. Preferably, the sealing strip 58 is permanently attached, such as by welding, to either the front or the rear section 40, 42 to form a flap. The free end of the flap preferably includes a fastening strip 60 that mates with a fastening strip 62 on the surface of the barge. Such fastening strips 60, 62 preferably are mating halves of a waterproof zipper, such as zipper model TZZNC8 from YKK, Inc. Alternatively, the fastening strips 60, 62 could be made of Velcro™ hooks and loops or other resealable fastening members.

It should be appreciated that it is not necessary to seal the zipper 44 using the sealing strip 58 or any other sealing means. In fact, some leakage of the sewage through the zipper 44 during transport would further increase the amount of dispersion of the sewage provided by the string of barges. As discussed above, dispersion of the sewage increases the ability of the ocean and its microorganisms to process the sewage without harm to the environment.

Figure 10:
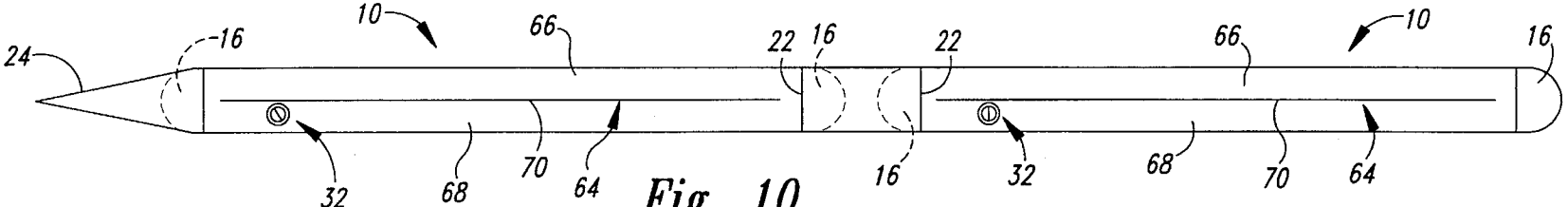
FIG. 10 is a top elevational view showing two barges coupled together showing a longitudinally elongated opening in accordance with the present invention.

In an alternate embodiment shown in FIG. 10, the barge 10 is provided with a longitudinally elongated opening 64 that divides the barge into a right section 66 and a left section 68. The longitudinally elongated opening 64 is closed by a releasable fastener 70 that couples the right section 66 with the left section 68. In the embodiment shown in FIG. 10, the releasable fastener 70 is a zipper similar to the zipper 44 shown in FIGS. 6–9.

The embodiment shown in FIG. 10 is appropriate for situations in which the cargo being transported in the barge is not intended to be discharged into the ocean. For example, the barge 10 can be used to transport wood chips from a sawmill to a discharge terminal. The wood chips are pumped into the barge via the input ports 32 or the opening 64. When the barge arrives at the discharge terminal, the barge is taken out of the water by a dry dock facility. The releasable fastener 70 is opened to expose the wood chips through the longitudinally elongated opening 64. Preferably, the longitudinally elongated opening 64 is long enough to enable the barge to collapse flat when the releasable fastener 70 is opened, thereby exposing the cargo on the flat barge 10. The wood chips can then be easily removed by any of various devices, such as a hydraulic shovel or a bulldozer.

As discussed herein, the present invention provides a flexible barge designed to efficiently discharge any of numerous types of cargo. The barge of the present invention includes an elongated opening that enables the cargo to be discharged much faster and more easily than would be possible using the small circular ports of prior art barges. The circumferentially elongated opening enables sewage to be efficiently discharged at countless locations in a large body of water. Alternatively, when transporting other cargo such as wood chips, the elongated opening can be longitudinal, which provides a much larger opening than is possible with the circumferentially elongated opening.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A flexible barge for transporting cargo having a density less than a body of water in which the barge is being used, comprising:

an elongated container of flexible fabric construction having an elongated opening formed between first and second fabric sections; and fastener elements attached to each of the first and second fabric sections of the elongated container, the fastener elements attached to the first fabric section being structured to releasably engage the fastening elements attached to the second fabric section and thereby releasably close the elongated opening of the elongated container, wherein when the fastening elements are disengaged the cargo can be discharged through the elongated opening.

2. The flexible barge of claim 1 wherein the fastening elements attached to the first fabric section are zipper teeth that releasably engage zipper teeth attached to the second fabric section.

3. The flexible barge of claim 2, further including:

a slide member that slides on the zipper teeth to engage and disengage the zipper teeth on the first fabric section with the zipper teeth on the second fabric section; and a zipper locking pin removably positioned between adjacent engaged zipper teeth adjacent the slide member and thereby releasably locking the slide member in place on the zipper teeth when the elongated opening is closed.

4. The flexible barge of claim 1 wherein the elongated container includes an elongated main body section and the elongated opening extends longitudinally substantially the entire length of the main body section.

5. The flexible barge of claim 1 wherein the elongated opening extends transversely with respect to the elongation of the elongated container.

6. The flexible barge of claim 5 wherein the elongated opening extends substantially completely around the elongated container such that the first fabric section is a front section of the elongated container and the second fabric section is a rear section of the elongated container.

7. The flexible barge of claim 1, further including an elongated flexible sealing strip that is removably positioned over the fastening elements, the sealing strip including first sealing means for sealing to the first fabric section of the elongated container and second sealing means for sealing to the second fabric section of the elongated container and thereby create a substantially watertight seal that substantially prevents water from entering or exiting the elongated container between the fastening elements.

8. The flexible barge of claim 7 wherein the sealing strip is a flap that is permanently sealed to the first fabric section of the elongated container and the flap is releasably sealed to the second fabric section of the elongated container by the second means for sealing.

9. A method of dispersing sewage using a flexible elongated first barge having an elongated opening extending transverse to the elongation of the first barge, the method comprising:

inputting the sewage into the first barge;

closing the elongated opening of the first barge using fastener elements attached to opposite sides of the elongated opening;

towing the first barge in the body of water with the elongated opening closed;

opening the elongated opening by separating the fastener elements on opposite sides of the elongated from each other; and discharging the sewage through the elongated opening.

10. The method of claim 9 wherein the step of inputting the sewage into the first barge includes inputting the sewage through a closeable input port after the elongated opening is closed.

11. The method of claim 9, further comprising:

coupling a second elongated flexible barge to the first barge, the second barge including an elongated opening that is releasably closed by fastening elements attached to opposite sides of the elongated opening of the second barge;

inputting the sewage into the second barge;

towing the second barge while the second barge is attached to the first barge;

opening the elongated opening of the second barge after the first barge is substantially empty of the sewage and after the second barge is towed to a location that is different from a location in which the elongated opening of the first barge was opened; and discharging the sewage of the second barge through the elongated opening.

12. The method of claim 9, further including towing the first barge while discharging the sewage through the elongated opening.

13. A flexible barge for transporting cargo, comprising:

an elongated container of flexible fabric construction having an elongated opening formed between first and second fabric sections; and a zipper having a first set of teeth attached to the first fabric section and a second set of teeth attached to the second fabric section, the teeth attached to the first fabric section being structured to releasably engage the teeth attached to the second fabric section and thereby releasably close the elongated opening of the elongated container.

14. The flexible barge of claim 13 wherein the elongated opening extends longitudinally in the elongated container.

15. The flexible barge of claim 14 wherein the elongated opening is sufficiently long to enable the flexible barge to collapse and lay flat when the elongated opening is opened.

16. The flexible barge of claim 13 wherein the elongated opening extends transversely with respect to the elongation of the elongated container.

17. The flexible barge of claim 16 wherein the elongated opening extends substantially completely around the elongated container such that the first fabric section is a front section of the elongated container and the second fabric section is a rear section of the elongated container.

18. The flexible barge of claim 13 further including an elongated flexible sealing strip that is removably positioned over the zipper, the sealing strip including first sealing means for sealing to the first fabric section and second sealing means for sealing to the second fabric section.

* * * * *